US005238275A

United States Patent [19]

Fretto

[11] Patent Number: 5,238,275

[45] Date of Patent: Aug. 24, 1993

[54] MULTI-LEVEL WINDOW SASH LOCK

[76] Inventor: Gerald M. Fretto, 88 Bock St., Rochester, N.Y. 14609

[21] Appl. No.: 10,354

[22] Filed: Jan. 28, 1993

[51] Int. Cl.[5] ..... E05C 17/50

[52] U.S. Cl. ..... 292/262; 292/241

[58] Field of Search ..... 292/190, 305, 262, 240, 292/241, 270, DIG. 47, DIG. 72, 242

[56] References Cited

U.S. PATENT DOCUMENTS

| | | | |
|---|---|---|---|
| 234,387 | 11/1880 | Burgess et al. | 292/242 |
| 661,404 | 11/1900 | Hubbard | 292/241 |
| 923,696 | 6/1909 | Packer | 292/241 |
| 1,746,291 | 2/1930 | Socha | 292/242 |
| 2,258,617 | 10/1941 | Knauff | 292/241 |
| 2,587,547 | 2/1952 | Steingruber | 292/241 X |
| 3,706,467 | 12/1972 | Martin | 292/DIG. 47 X |

*Primary Examiner*—Richard E. Moore
*Attorney, Agent, or Firm*—Robert J. Bird

[57] ABSTRACT

A locking mechanism for a double hung window includes a strike bracket and a locking member. The strike bracket attaches to the upper window sash, and has an upstanding locking plate with a vertical series of locking hooks, each extending inward and curling downward and back outward. The locking member attaches to the lower window sash, and has a rotatable clasp with a clasp hook extending outward and curling upward and back inward. The clasp hook selectively engages the locking hooks on an inward and downward line of action to clamp the window sashes together against relative movement, both vertical and horizontal.

1 Claim, 1 Drawing Sheet 34
33
32
32
31
30
10
25
20
22
24
20
11
30
20
12
40
13
33
23
30
34
32
21
32
31
12
11
14
10

MULTI-LEVEL WINDOW SASH LOCK

FIELD OF THE INVENTION

This invention relates to double hung windows, and more particularly to a locking device for locking the window sashes to each other, either in the closed position or at selected open positions.

BACKGROUND INFORMATION

A double hung window is one with upper and lower sashes vertically slidable in a window frame. Such a window usually includes a lock to clamp the upper and lower sashes together when they are closed. The common form of this type of window lock includes a "strike" member mounted on the bottom rail of the upper sash, and a rotatable locking member mounted on the top rail of the lower sash. The locking member is rotatable into and out of locking engagement with the strike member when the sashes are closed. The window is therefore lockable only when it is closed. When it is open, it is unlocked and the sashes are freely movable up and down.

The prior art also includes U.S. Pat. No. 761,568 issued May 31, 1904 to Wedler, disclosing a double hung window with adjustable locking. An extension arm is attached to the upper sash, pivotable from a horizontal (inoperative) position to an erect (operative) position. The extension arm has a series of holes spaced along it. A lever-operated plunger mechanism is attached to the lower sash. The plunger is movable into and out of the extension arm holes to lock the window closed, or at a selected open position. The Wedler lock prevents relative up or down movement of the window sashes, but it is a relatively complex mechanism. Furthermore, it does not pull or tighten the window sashes together against rattle or air leakage.

SUMMARY OF THE INVENTION

The present invention is a locking mechanism for a double hung window. A strike bracket attached to the upper window sash has an upstanding locking plate with a vertical series of locking hooks, each extending inward and curling downward and back outward. A locking member attached to the lower window sash has a rotatable clasp with a clasp hook extending outward and curling upward and back inward. The clasp hook selectively engages the locking hooks on an inward and downward line of action to clamp the window sashes together against relative movement, both vertical and horizontal.

DRAWING

DESCRIPTION

Figures 1, 2, 3:
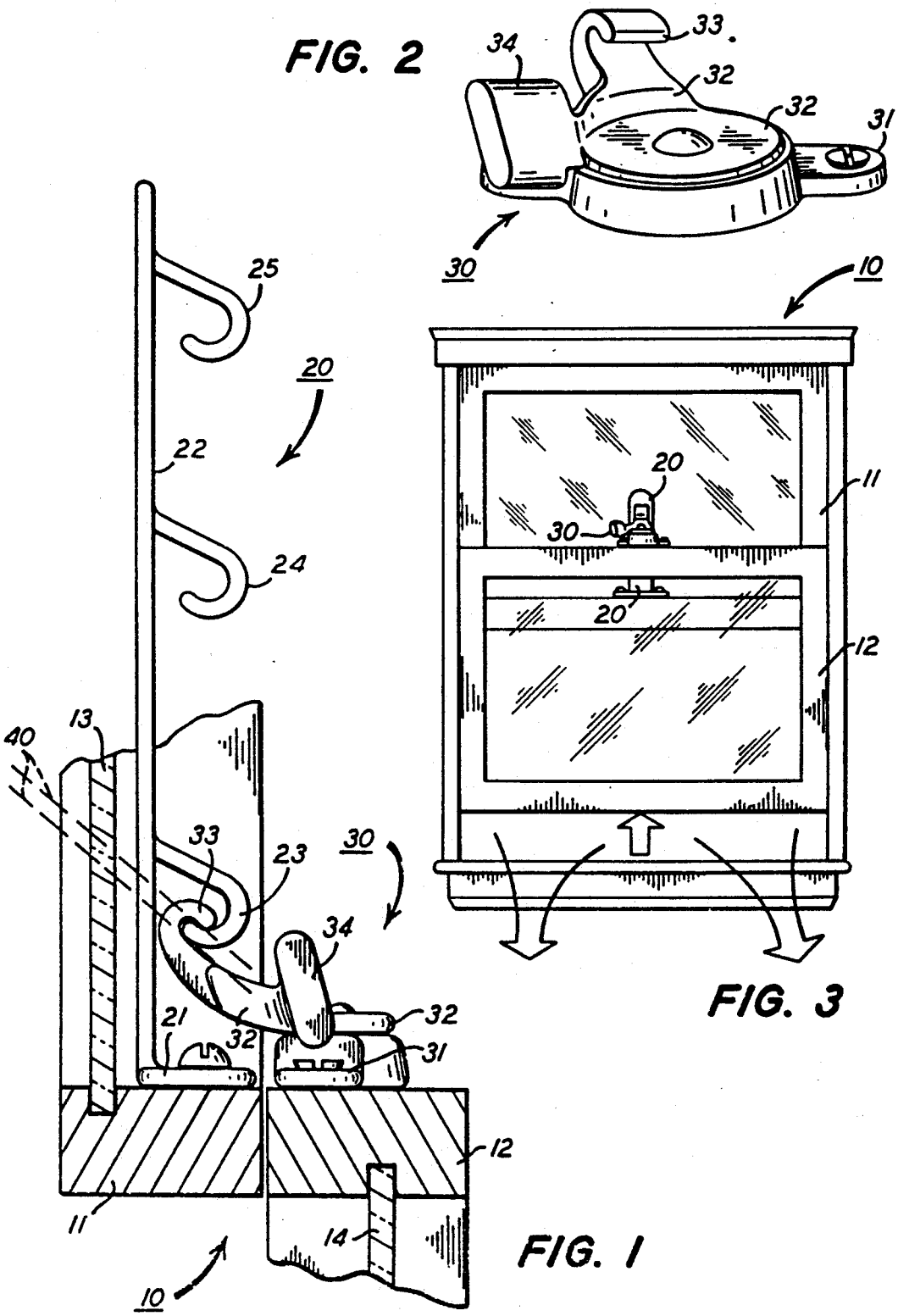
FIG. 1 is a side view, partly in section, of my window lock.
FIG. 2 is a three dimensional view of the rotatable locking member.
FIG. 3 illustrates the use of my window lock.

Referring to FIG. 1, a double hung window 10 is represented by partial sections of an upper sash 11 with an upper window pane 13 mounted in it, and a lower sash 12 with a lower window pane 14 mounted in it.

The upper sash 11 includes a strike bracket 20 fastened to it. The strike bracket 20 includes a base mounting flange 21 for attachment to the upper sash 11, and an upstanding locking plate 22. The locking plate 22 includes a vertical series of locking hooks 23, 24, 25. The locking hooks are curved, each extending inward from the locking plate 22, and curling downward and back outward as shown in FIG. 1.

The lower sash 12 includes a locking member 30 fastened to it. The locking member 30 includes a stationary base plate 31 for attachment to the lower sash 12, and a rotatable clasp 32 mounted on the base plate 31. The clasp 32 includes a curved clasp hook 33 extending outward from the base plate 31, and curling upward and back inward as shown in FIG. 1. The clasp 32 also includes a handle or tab 34 by which to actuate the clasp.

The curved configurations of the locking hooks 23, 24, 25 on the bracket 20, and of the clasp hook 33, are complementary of each other. They engage or bear on each other on a line of action 40. The line of action represents the direction o the force applied to the locking hook 23 by the clasp hook 33. The force, or line of action, is inward and downward as shown, clamping the window sashes together. This positively prevents relative movement of the sashes, vertical or horizontal.

This is significant when the window is locked in an open position, as in FIG. 3. In this condition, the lower sash is raised and the clasp hook 33 engages locking hook 24, for example. This locking engagement locks the window against further opening and against closing, accidental or otherwise. Furthermore, the clamping action of the clasp hook 33 on the locking hook 23 (or 24, or 25) draws the window sashes 11 and 12 tightly together against rattle and (when the window is closed) against air leakage, unlike the action of the Wedler device discussed above.

In this specification, "inward" is the direction from outside to inside the window, and "outward" is the direction from inside to outside the window.

The foregoing description of a preferred embodiment of this invention, including any dimensions, angles, or proportions, is intended as illustrative. The concept and scope of the invention are limited only by the following claims and equivalents thereof.

What is claimed is:

1. A double hung window locking mechanism, including:

a strike bracket for attachment to the upper sash of said window, said strike bracket including a base flange and an upstanding locking plate, said locking plate including a vertical series of locking hooks, each said hook extending inward of said plate and curling downward and back outward;

a locking member for attachment to the lower sash of said window, said locking member including a stationary base plate and a rotatable clasp mounted thereon, said clasp including a clasp hook extending outward of said base plate and curling upward and back inward;

said clasp hook selectively engaging said locking hooks on an inward and downward line of action to clamp said window sashes together against relative movement, both vertical and horizontal.

* * * * *